US011374362B2

(12) United States Patent
Uchida

(10) Patent No.: US 11,374,362 B2
(45) Date of Patent: Jun. 28, 2022

(54) ELECTRICAL CONNECTOR

(71) Applicant: DAI-ICHI SEIKO CO., LTD., Kyoto (JP)

(72) Inventor: Tomoyuki Uchida, Machida (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 39 days.

(21) Appl. No.: 17/143,612

(22) Filed: Jan. 7, 2021

(65) Prior Publication Data

US 2021/0184401 A1 Jun. 17, 2021

Related U.S. Application Data

(63) Continuation of application No. 16/381,742, filed on Apr. 11, 2019, now Pat. No. 10,923,858.

(30) Foreign Application Priority Data

Apr. 27, 2018 (JP) ..... JP2018-086068

(51) Int. Cl.

| | |
|---|---|
| ***H01R 4/66*** | (2006.01) |
| ***H01R 13/6471*** | (2011.01) |
| ***H01R 9/05*** | (2006.01) |
| ***H01R 13/40*** | (2006.01) |
| ***H01R 13/6585*** | (2011.01) |

(52) U.S. Cl.

CPC ..... *H01R 13/6471* (2013.01); *H01R 9/05* (2013.01); *H01R 13/40* (2013.01); *H01R 13/6585* (2013.01)

(58) Field of Classification Search

CPC ..... H01R 13/6471; H01R 13/6585; H01R 13/40; H01R 9/05

USPC ..... 439/95, 98–99, 108

See application file for complete search history.

(56) References Cited

U.S. PATENT DOCUMENTS

| | | | |
|---|---|---|---|
| 6,129,555 | A | 10/2000 | Daikuhara et al. |
| 6,315,608 | B1 | 11/2001 | Lopata et al. |
| 2005/0054226 | A1 | 3/2005 | Akama et al. |

(Continued)

FOREIGN PATENT DOCUMENTS

| | | | |
|---|---|---|---|
| CN | 107069348 | A | 8/2017 |
| CN | 107453079 | A | 12/2017 |

(Continued)

OTHER PUBLICATIONS

Notification of Reasons of Refusal (JP Patent Application No. 2018-086068); dated Feb. 18, 2020; 6 pages; Includes English Translation.

(Continued)

*Primary Examiner* — Khiem M Nguyen

(74) *Attorney, Agent, or Firm* — Howard & Howard Attorneys PLLC

(57) ABSTRACT

Walls are erected at both ends of an arrangement of first contacts and at locations that partition the first contacts for each signal to be transmitted, project at both ends of an arrangement of second contacts and at locations that partition the second contacts for each pair of differential signals to be transmitted, and therewith are connected to ground electrodes of a circuit board. A first shell, a second shell, and the like are mounted to a first housing and a second housing in such a manner as to be spaced apart from and cover the first contacts, the second contacts, and the walls and are connected to ground electrodes of the circuit board.

7 Claims, 12 Drawing Sheets

(56) References Cited

U.S. PATENT DOCUMENTS

| | | | |
|---|---|---|---|
| 2014/0187085 | A1 | 7/2014 | Nishimura |
| 2017/0141499 | A1 | 5/2017 | Mashima et al. |

FOREIGN PATENT DOCUMENTS

| | | | |
|---|---|---|---|
| JP | 2000-67955 | A | 3/2000 |
| JP | 3694485 | A | 10/2003 |
| JP | 2005-085686 | A | 3/2005 |
| JP | 2008-041656 | A | 2/2008 |
| JP | 2017-097972 | A | 6/2017 |

OTHER PUBLICATIONS

Notification of First Office Action (CN Application No. or Patent No. 201910319737.2); dated Jun. 1, 2020; 13 pages; Includes English Translation.

ELECTRICAL CONNECTOR

CROSS-REFERENCE TO RELATED APPLICATION

This application is a continuation of U.S. patent application Ser. No. 16/381,742, filed Apr. 11, 2019, which claims priority to Japanese Patent Application No. 2018-086068, filed on Apr. 27, 2018, the entire disclosures of which are incorporated by reference herein.

FIELD

This application relates to an electrical connector.

BACKGROUND

The Unexamined Japanese Patent Application Kokai Publication No. 2008-041656 discloses a connector that includes a plurality of signal contacts every two of which constitute a pair and a plurality of ground contacts every two of which constitute a pair. One end sides of the signal contacts and the ground contacts are arranged in a row in such a sequence that every pair of ground contacts sandwich a pair of signal contacts. On the other hand, the other end sides of the signal contacts and the ground contacts are arranged in such a manner that the respective contacts form the respective vertices of trapezoids and links between signal contacts adjacent to each other and links between ground contacts adjacent to each other form upper bases and lower bases, respectively, of the trapezoids. In each of the trapezoids, the upper base and the lower base are parallel with each other and the upper base is shorter than the lower base. Arrangement of the signal contacts and the ground contacts as described above enables transmission quality in differential transmission to be improved.

However, the electrical connector disclosed in the Unexamined Japanese Patent Application Kokai Publication No. 2008-041656 has limitation in suppression of crosstalk. For this reason, there is a possibility that resonance may occur in a frequency band in which signals are transmitted and transmission quality of signals may deteriorate.

The present disclosure is made in consideration of the above-described actual situation, and an objective of the present disclosure is to provide an electrical connector that is capable of preventing transmission quality of signals from deteriorating.

SUMMARY

In order to achieve the objective described above, an electrical connector of the present disclosure is an electrical connector that includes a first connector that is mounted on a circuit board and a second connector that is connected to coaxial cables and, through fitting of the first connector and the second connector to each other, connects the circuit board and the coaxial cables to each other, in which the first connector includes a plurality of conductive first contacts to each of which a board connecting portion that connects to the circuit board, a rising portion that, bending at one end of the board connecting portion, extends in a direction away from the circuit board, and a first contact contacting portion that, bending at one end of the rising portion, extends in a direction along the circuit board and comes into contact with an opposite contact disposed to the second connector are formed and that are arranged in a row, conductive walls that are connected to ground electrodes of the circuit board, are erected at both ends of an arrangement of the first contacts and at locations that partition the first contacts for each signal to be transmitted, and project at both ends of an arrangement of the opposite contacts and at locations that partition the opposite contacts for each signal to be transmitted, an insulating first housing that holds the first contacts and the walls, and a conductive first shell that is mounted to the first housing in such a manner as to be spaced apart from and cover the first contacts and the walls and is connected to a ground electrode of the circuit board.

In this case, the second connector may include a plurality of conductive second contacts to each of which a cable connecting portion that connects to an inner conductor of one of the coaxial cables and a second contact contacting portion that comes into contact with one of the first contact contacting portions when the second connector is fitted to the first connector are formed and that extend in a direction along the circuit board, are arranged in a row in a corresponding manner to the first contacts, and serve as the opposite contacts, an insulating second housing that holds the second contacts and to which gaps for housing the walls projecting from the first connector are disposed, a conductive second shell that is mounted to the second housing in such a manner as to be spaced away from and cover the second contacts and the walls and is connected to the first shell when the second connector is fitted to the first connector, and a conductive ground bar that connects to outer conductors of the coaxial cables and connects to the second shell.

The electrical connector may be configured in such a way that based on a phenomenon in which, as a height of each of the walls above the circuit board decreases, a resonant frequency of each transmission line including one of the first contacts and one of the second contacts increases, the height of each of the walls above the circuit board is specified to a height corresponding to a frequency band of a noise targeted to be suppressed.

The electrical connector may also be configured in such a way that a height of each of the walls above the circuit board is equal to a maximum height of each transmission line that is constituted by one of the first contacts, one of the second contacts, and an inner conductor of one of the coaxial cables above the circuit board.

The electrical connector may also be configured in such a way that a height of each of the walls from the circuit board changes in accordance with a height of one of the arranged first contacts, one of the arranged second contacts, and an inner conductor of one of the arranged coaxial cables.

The electrical connector may also be configured in such a way that a height of each of the walls above the circuit board is higher than a height of an inner conductor of one of the coaxial cables above the circuit board.

The electrical connector may also be configured in such a way that a length of each of the walls along the circuit board is longer the length of each transmission line constituted by one of the first contacts and one of the second contacts along the circuit board.

The electrical connector may also be configured in such a way that a gap between each of the walls and the first and second shells is shorter than a half wavelength of a signal transmitted via one of the first contacts and one of the second contacts.

The electrical connector may also be configured in such a way that the walls partition the contacts from each other for each pair of contacts transmitting a pair of differential signals.

The electrical connector may also be configured in such a way that each of the coaxial cables includes a pair of inner conductors that transmit a pair of differential signals, and the pair of inner conductors are connected to a pair of the second contacts sandwiched by the walls.

According to the present disclosure, conductive walls that are erected with respect to a circuit board are disposed at both ends of an arrangement of first contacts and opposite contacts and at locations that partition the first contacts and the opposite contacts for each signal to be transmitted, and the walls are spaced apart from a shell. Since such a configuration enables the upper edges of the walls to be positioned in proximity to the first contacts and the opposite contacts, noise components generated due to resonance of transmission lines including the contacts easily propagate to the walls. As a result of this effect, it is possible to prevent transmission quality of signals from deteriorating.

BRIEF DESCRIPTION OF THE DRAWINGS

A more complete understanding of this application can be obtained when the following detailed description is considered in conjunction with the following drawings, in which.

DETAILED DESCRIPTION

Hereinafter, an electrical connector according to an embodiment of the present disclosure will be described in detail with reference to the drawings. In all the drawings, the same reference symbols are assigned to the same or equivalent constituent elements. In the electrical connector according to the present embodiment, walls made of a conductor are disposed between transmission lines so as to reduce crosstalk between the transmission lines.

Figure 1:
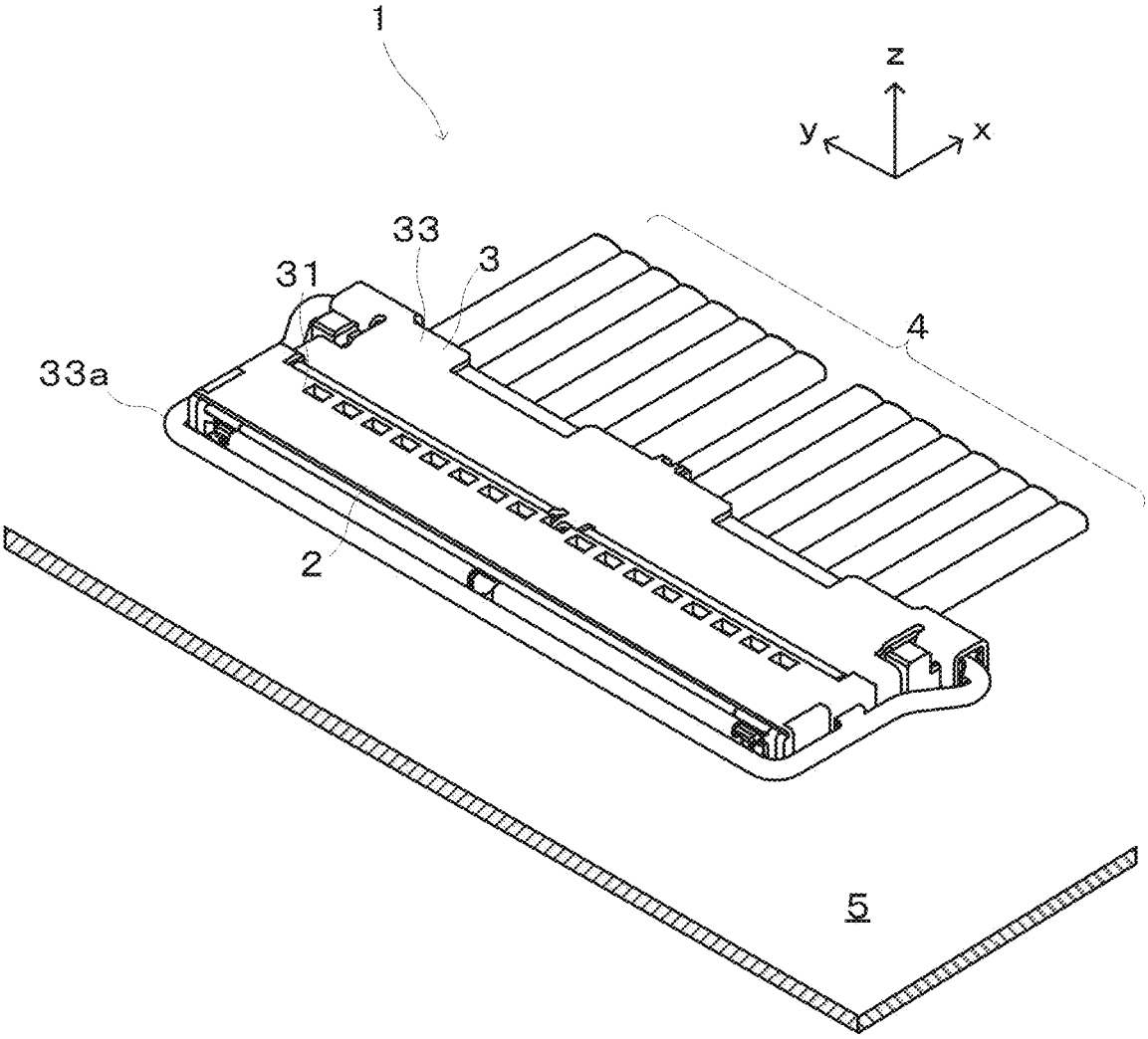
FIG. 1 is a perspective view illustrating a configuration of an electrical connector according to an embodiment of the present disclosure.

As illustrated in FIG. 1, an electrical connector 1 according to the present embodiment includes a receptacle connector 2 serving as a first connector and a plug connector 3 serving as a second connector. The receptacle connector 2 is mounted on a circuit board 5, and, to the plug connector 3, 16 coaxial cables 4 are connected.

Fitting of the receptacle connector 2 and the plug connector 3 to each other causes the 16 coaxial cables 4 and circuits on the circuit board 5 to be connected to each other. In the present embodiment, each coaxial cable 4 contains a pair of inner conductors 4*a* and transmits a pair of differential signals. Therefore, the electrical connector 1 is capable of transmitting 16 pairs of differential signals simultaneously.

First, a configuration of the receptacle connector 2 will be described. As illustrated comprehensively in FIGS. 2A, 2B, 3A, 3B, and 3C, the receptacle connector 2 includes first contacts 20, a first housing 21, walls 22A, and a first shell 23.

Figure 3A:
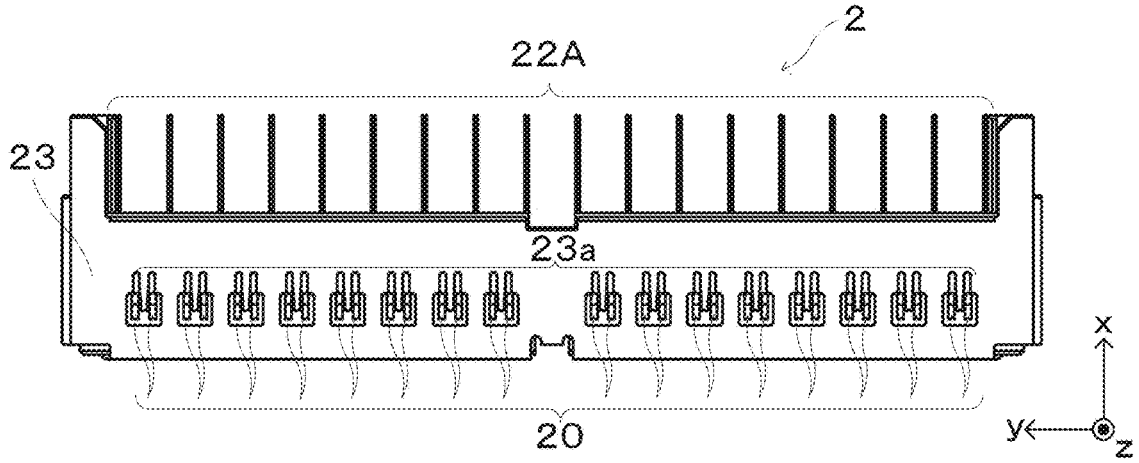
FIG. 3A is a top view of the receptacle connector.
Figure 3B:
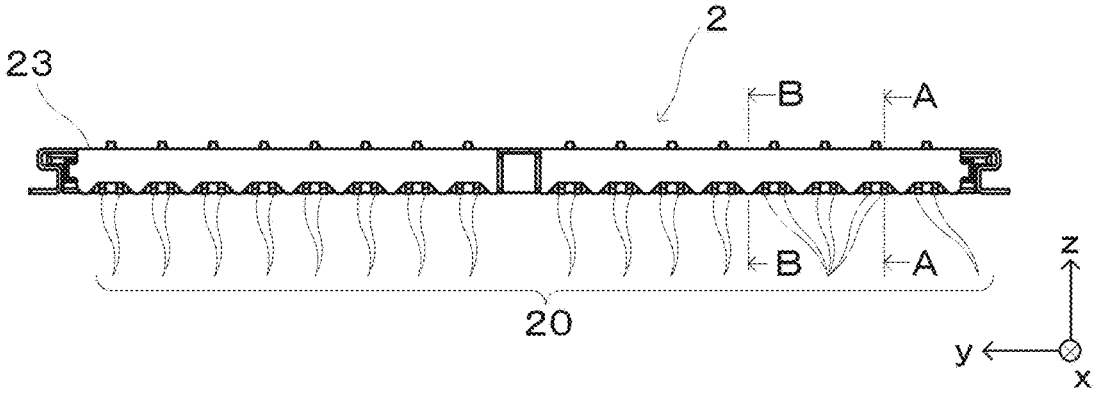
FIG. 3B is a front view of the receptacle connector.
Figure 3C:
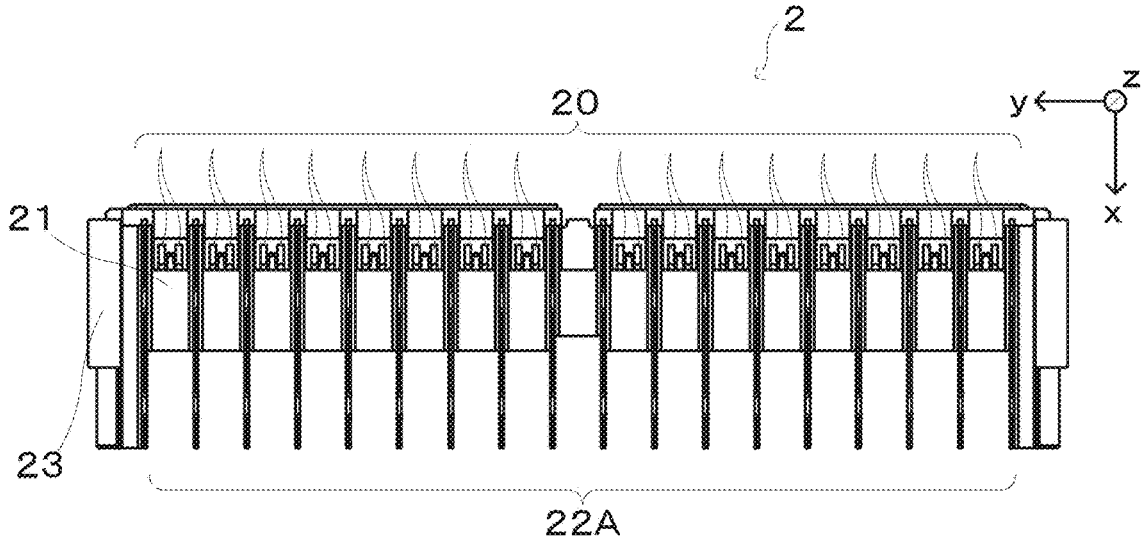
FIG. 3C is a bottom view of the receptacle connector.
Figure 4A:
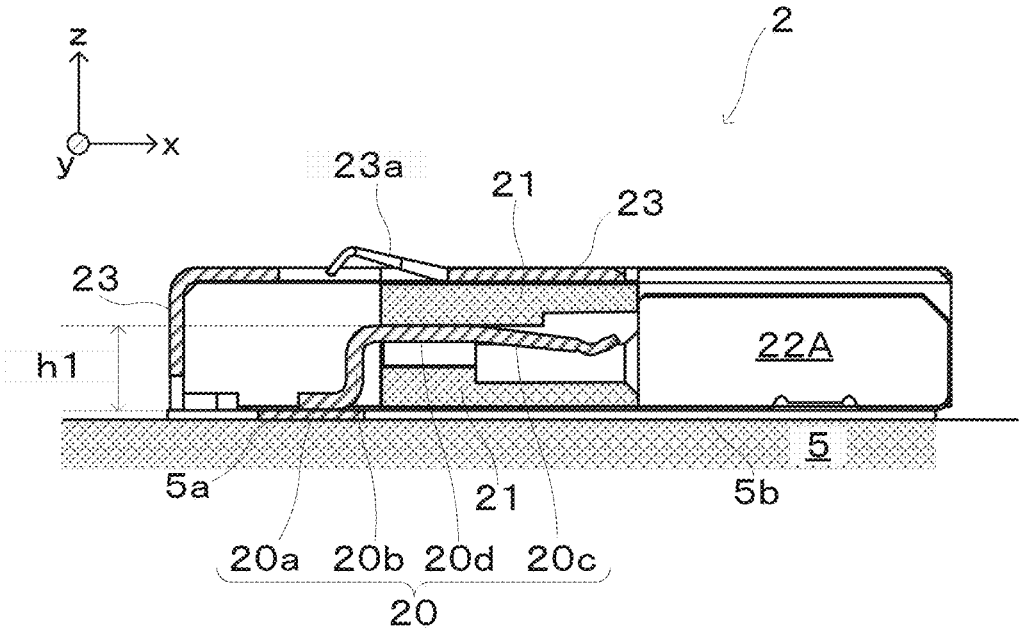
FIG. 4A is a cross-sectional view taken along the line A-A in FIG. 3B.

Each first contact 20 is a conductive member made of a metal with the longitudinal direction thereof aligned with the x-axis direction, as illustrated in FIG. 4A. As illustrated in FIGS. 3A to 3C, 32 first contacts 20 are disposed, matching the number of inner conductors 4*a* in the coaxial cables 4. The first contacts 20 are arranged in a row in the y-axis direction in a corresponding manner to opposite contacts (second contacts 30 in the plug connector 3, to be described later). In the present embodiment, every two first contacts 20 arranged adjacent to each other are paired and transmit a pair of differential signals.

As illustrated in FIG. 4A, to each first contact 20, a board connecting portion 20*a* that connects to the circuit board 5 is formed. Each board connecting portion 20*a* is connected to a signal electrode 5*a* on the circuit board 5 by means of soldering. To each first contact 20, a rising portion 20*b* that, bending at one end of the board connecting portion 20*a*, extends in a direction away from the circuit board 5 is also formed.

Further, to each first contact 20, a first contact contacting portion 20*c* that, bending at one end of the rising portion 20*b*, extends in a direction along the circuit board 5 and comes into contact with an opposite contact (a second contact 30) is also formed. Between the rising portion 20*b* and the first contact contacting portion 20*c*, a locking portion 20*d* that is locked to the first housing 21 is disposed.

As described above, in each first contact 20, while the board connecting portion 20*a* is arranged along the circuit board 5, the locking portion 20*d* and the first contact contacting portion 20*c* are arranged at a height h1 with respect to the circuit board 5 taken as a reference, that is, the height h1 above the circuit board 5. The height h1 is set to be a maximum height of each first contact 20 above the circuit board 5.

Figure 4B:
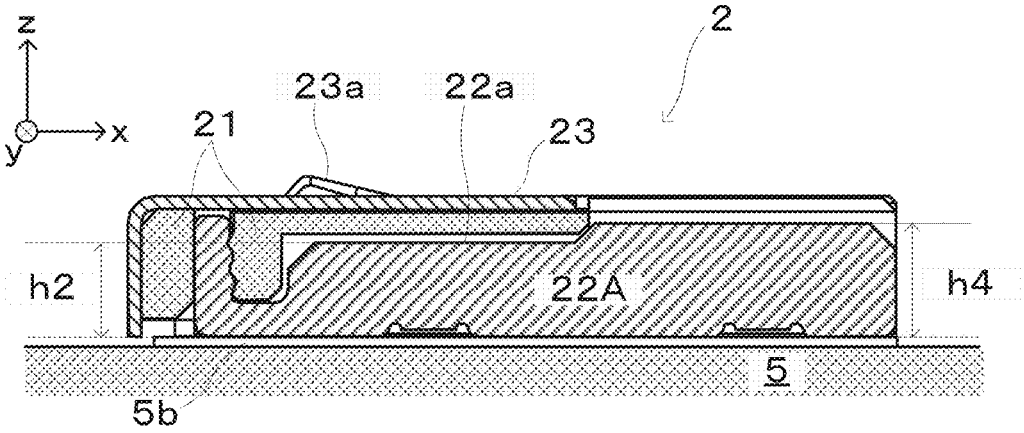
FIG. 4B is a cross-sectional view taken along the line B-B in FIG. 3B.

The first housing 21 is an insulating member made of a resin. The first housing 21 holds the first contacts 20 with the plurality of first contacts 20 extending in the x-axis direction and arranged in a row in the y-axis direction, as illustrated in FIGS. 3C and 4A. Further, the first housing 21 holds the walls 22A with the walls 22A extending in the x-axis direction and arranged in a row in the y-axis direction, as illustrated in FIGS. 3C and 4B.

The walls 22A are conductive members press-fitted into the first housing 21. As illustrated in FIG. 4B, the walls 22A, extending in the x-axis direction, are erected at both ends of the arrangement of the first contacts 20 on the circuit board 5. Further, the walls 22A are erected at locations that partition the arrangement of the first contacts 20 for each transmitted signal (each pair of differential signals) on the circuit board 5, as illustrated in FIGS. 3A and 3C. As illustrated in FIG. 4B, each wall 22A is soldered to a ground electrode 5*b* on the circuit board 5.

In the present embodiment, with regard to each wall 22A, a maximum height of a portion facing a first contact 20 above the circuit board 5 is h2 and a maximum height of a portion facing an opposite contact and an inner conductor 4*a* in a coaxial cable 4, to be described later, above the circuit board 5 is h4.

Figure 2A:
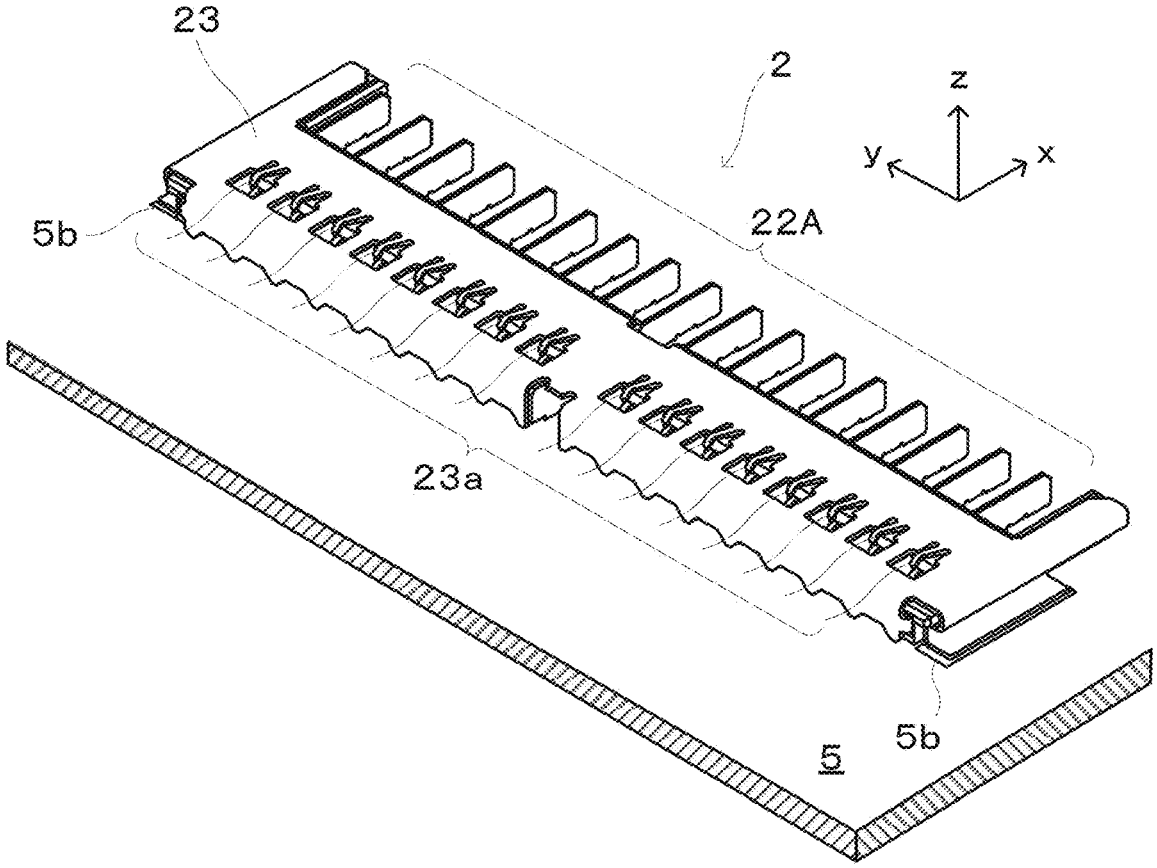
FIG. 2A is a perspective view of a receptacle connector constituting the electrical connector.
Figure 2B:
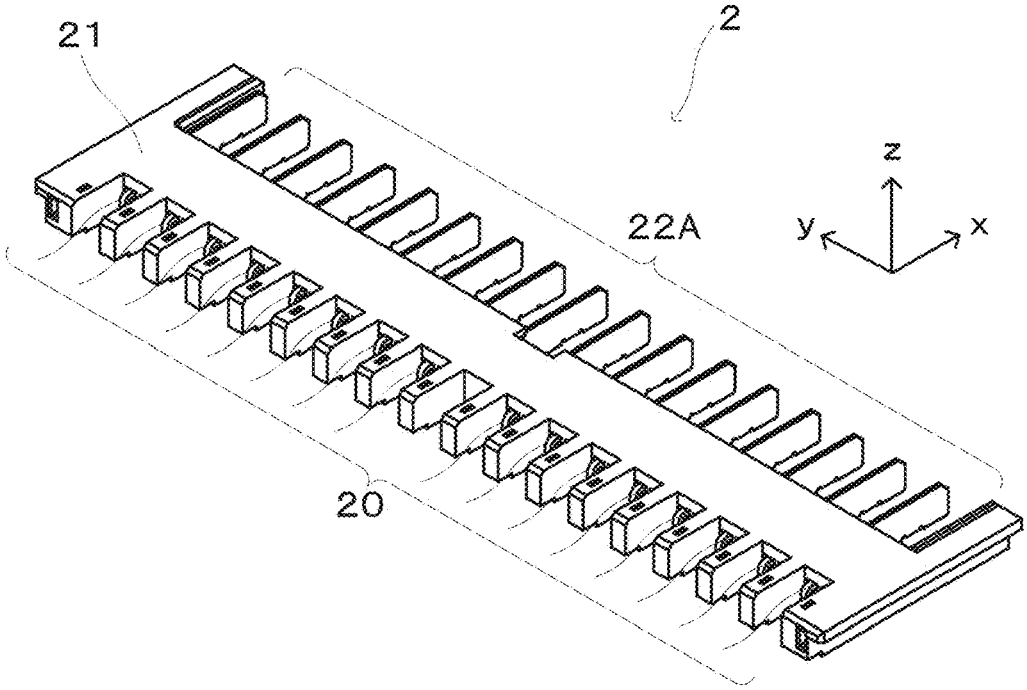
FIG. 2B is a perspective view of the receptacle connector that is in a state of being not mounted on a circuit board with a first shell thereof removed.

As illustrated in FIG. 2A, the first shell 23 is mounted to the first housing 21 in such a manner as to cover the first contacts 20 and the walls 22A. The first shell 23 connects to ground electrodes 5*b* on the circuit board 5 and thereby functions as an electromagnetic shield member for transmission lines including the first contacts 20. As illustrated in FIG. 2A, to the first shell 23, a plurality of contact pieces 23*a* for contacting a second shell (shell B) 34, to be described later, are disposed along the y-axis direction.

As illustrated in FIGS. 4A and 4B, the first shell 23 is spaced apart from the first contacts 20 and the walls 22A. Specifically, the first shell 23 is not connected to the walls 22A, and, to each wall 22A, an upper edge 22*a* is formed. Since preventing the first shell 23 from being connected to the walls 22A enables gaps between the first shell 23 and the first contacts 20 to be widened, it is possible to reduce return loss, which is one of indices indicating transmission quality of signals transmitted through the first contacts 20, and thereby improve reflection characteristics of the transmission lines.

Next, a configuration of the plug connector 3 will be described. As illustrated comprehensively in FIGS. 5A, 5B, 6A, 6B, and 6C, the plug connector 3 includes second contacts 30 serving as opposite contacts, a second housing 31, ground bars 32, a second shell (shell A) 33, and a second shell (shell B) 34.

Figure 5A:
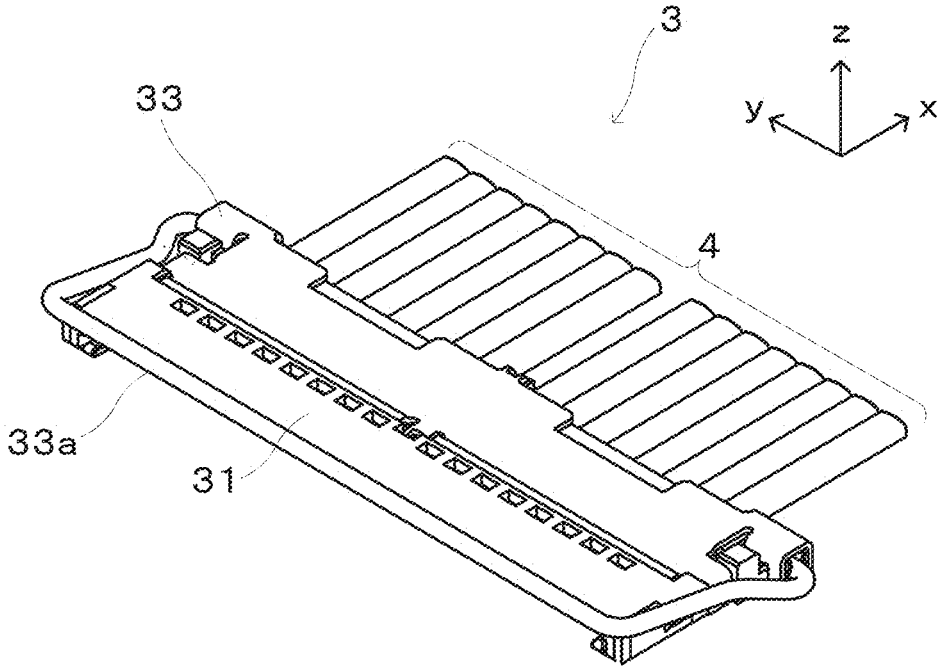
FIG. 5A is a perspective view of a plug connector constituting the electrical connector.
Figure 5B:
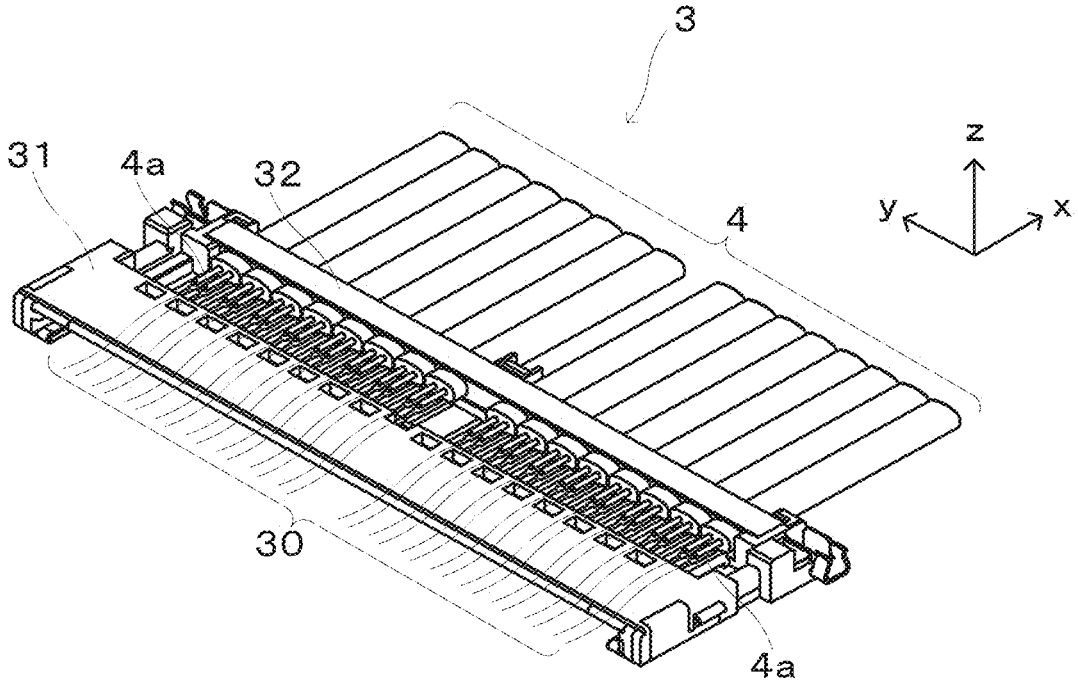
FIG. 5B is a perspective view of the plug connector a portion of the second shell of which is removed.
Figure 7A:
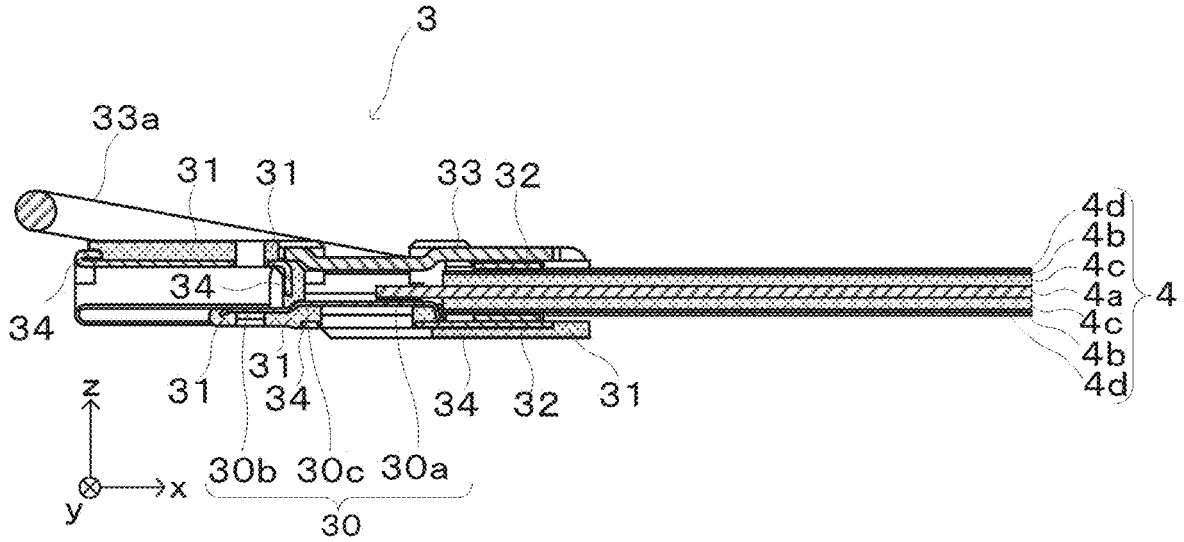
FIG. 7A is a cross-sectional view taken along the line C-C in FIG. 6B.

As illustrated in FIG. 7A, each second contact 30 is a conductive member with the longitudinal direction thereof aligned with the x-axis direction. The second contacts 30 are arranged in a row in the y-axis direction in a corresponding manner to opposite contacts (the first contacts 20 of the receptacle connector 2), as illustrated in FIG. 5B. In the present embodiment, every two second contacts 30 arranged adjacent to each other are paired and transmit a pair of differential signals.

As illustrated in FIG. 7A, to each second contact 30, a cable connecting portion 30*a* that connects to an inner conductor 4*a* in a coaxial cable 4 is formed. In addition, to each second contact 30, a second contact contacting portion 30*b* that comes into contact with a first contact 20 is formed. Further, to each second contact 30, a locking portion 30*c* that is locked to the second housing 31 is formed.

Figure 6A:
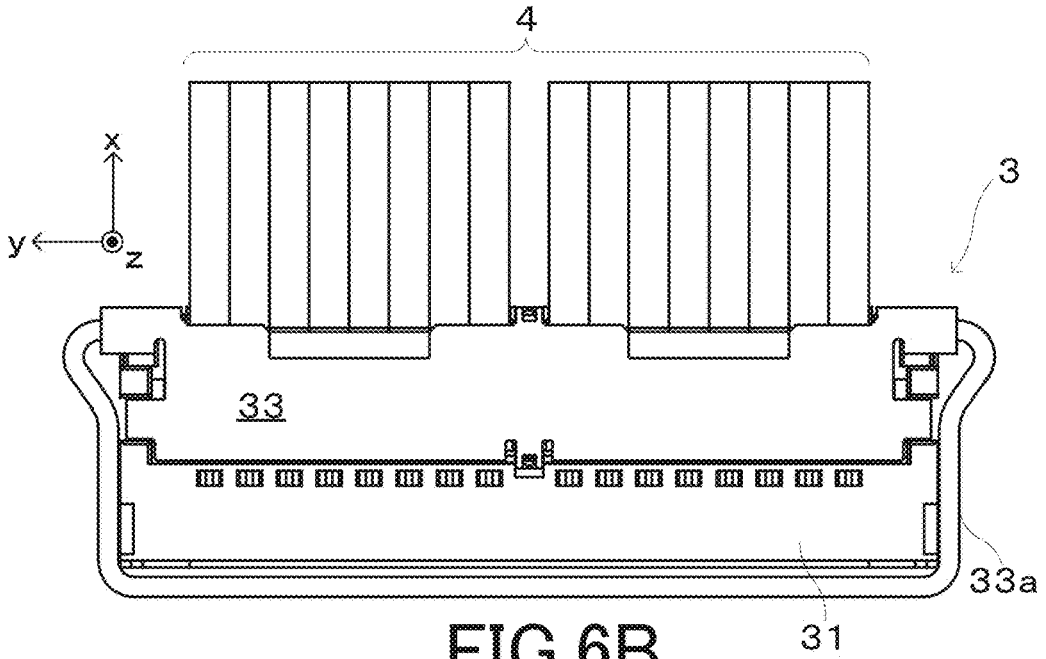
FIG. 6A is a top view of the plug connector.
Figure 6B:
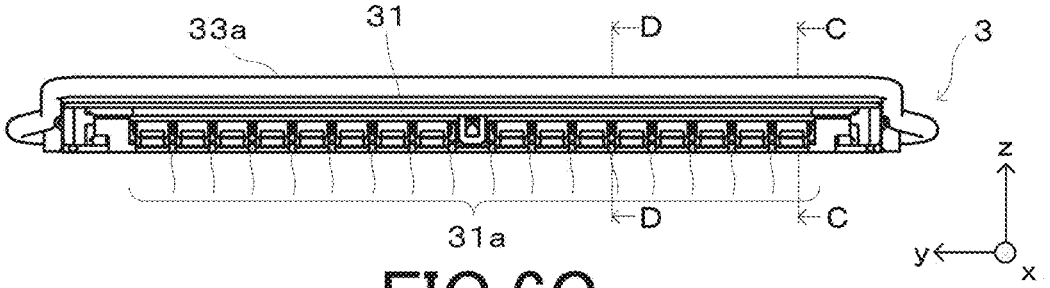
FIG. 6B is a front view of the plug connector.
Figure 6C:
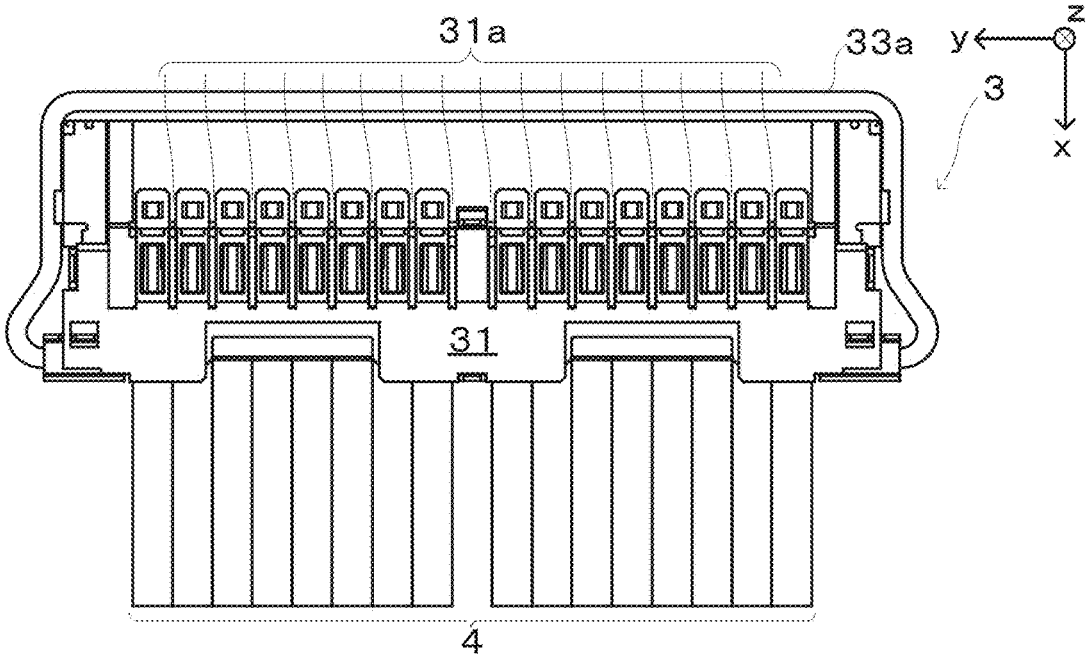
FIG. 6C is a bottom view of the plug connector.

The second housing 31 is an insulating member. The second housing 31 holds the second contacts 30 with the plurality of second contacts 30 extending in the x-axis direction, as illustrated in FIG. 7A, and arranged in a row in the y-axis direction, as illustrated in FIG. 5B. Further, the second housing 31 holds one of the ground bars 32, the second shell (shell A) 33, and the second shell (shell B) 34. As illustrated in FIGS. 6B and 6C, to the second housing 31, grooves 31*a* into which the walls 22A, which project from the receptacle connector 2, are inserted are disposed.

As illustrated in FIG. 5B, the ground bars 32 are conductive members that extend in the y-axis direction and are formed into plate shapes. The ground bars 32 are connected to an outer conductor 4*b* of each coaxial cable 4, sandwiching the coaxial cable 4 at upper and lower portions of the outer conductor 4*b* and are also connected to the second shell 34 (shell B), as illustrated in FIG. 7A. As illustrated in FIG. 7A, in each coaxial cable 4, an insulator 4*c* is interposed between the inner conductors 4*a* and the outer conductor 4*b* and an outer coating 4*d* is formed on the outer side of the outer conductor 4*b*, that is, at the outermost portion.

Figure 7B:
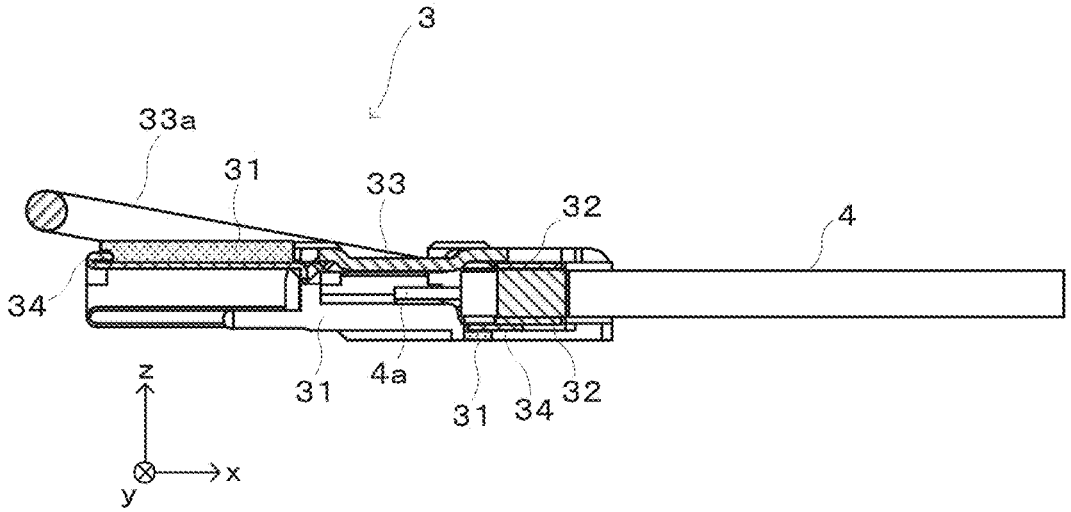
FIG. 7B is a cross-sectional view taken along the line D-D in FIG. 6B.

As illustrated in FIGS. 7A and 7B, the second shell (shell A) 33 and the second shell (shell B) 34 are conductive members. The second shell (shell A) 33 is mounted to the second housing 31 after the coaxial cables 4 are wire-connected to the second contacts 30. The second shell (shell B) 34 is formed integrally and simultaneously with the second housing 31 at the time of resin-molding the second housing 31. As illustrated in FIGS. 5A, 7A, and 7B, the second shell (shell A) 33 and the second shell (shell B) 34 are in contact with each other. As illustrated in FIG. 7A, the second shell (shell A) 33 and the second shell (shell B) 34 are mounted to the second housing 31 in such a manner as to be spaced apart from and cover the second contacts 30 and, when the plug connector 3 is fitted to the receptacle connector 2, come into contact with the first shell 23. In addition, to the second shell 33, a pull bar 33*a* for reinforcing a connection state of the plug connector 3 to the receptacle connector 2 is disposed.

Figure 8A:
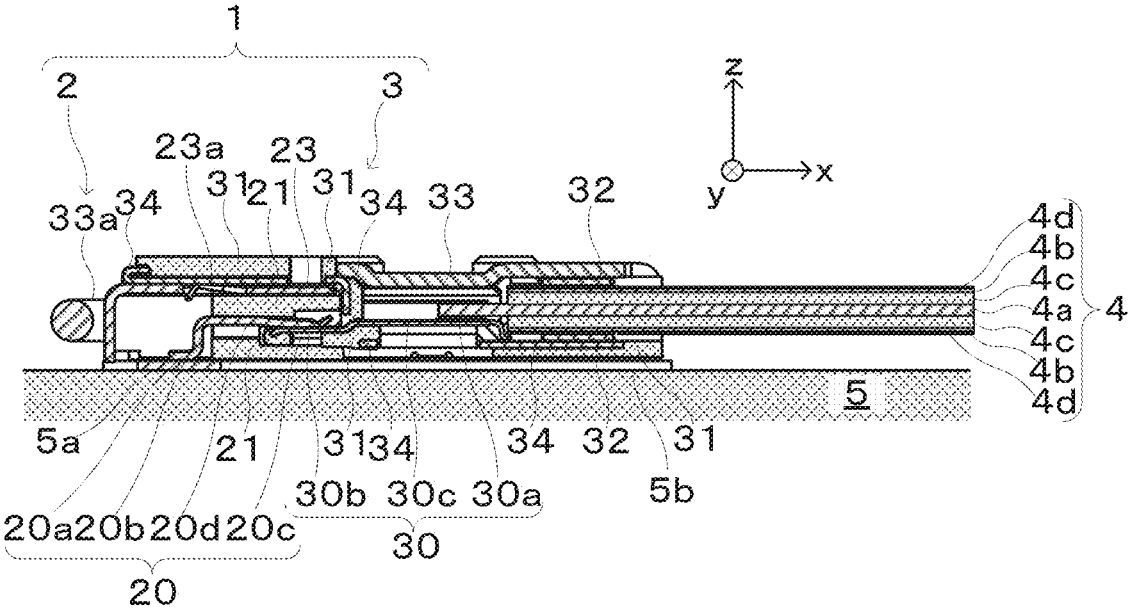
FIG. 8A is a cross-sectional view of the receptacle connector and the plug connector taken along the line A-A in FIG. 3B and the line C-C in FIG. 6B when the connectors are fitted to each other.
Figure 8B:
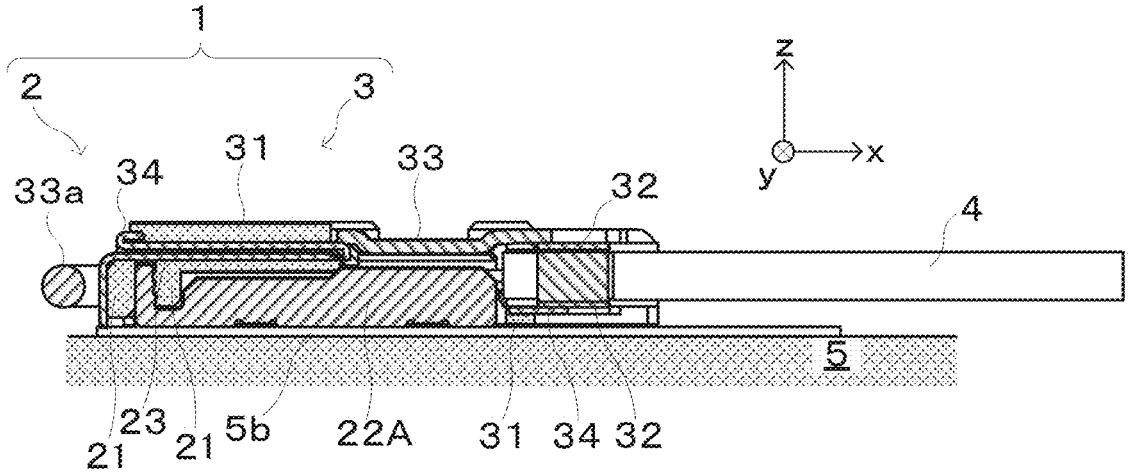
FIG. 8B is a cross-sectional view of the receptacle connector and the plug connector taken along the line B-B in FIG. 3B and the line D-D in FIG. 6B when the connectors are fitted to each other.

When, as illustrated in FIG. 1, the plug connector 3 is fitted into the receptacle connector 2 mounted on the circuit board 5 and the pull bar 33*a* is turned and locked to the receptacle connector 2, the receptacle connector 2 and the plug connector 3 is brought to a state illustrated in FIGS. 8A and 8B.

In this case, as illustrated in FIG. 8A, the first contact contacting portions 20*c* of the first contacts 20 and the second contact contacting portions 30*b* of the second contacts 30 come into contact with each other. This contact forms transmission lines for signals starting from the signal electrodes 5*a* of the circuit board 5, passing the first contacts 20 and the second contacts 30, and reaching the inner conductors 4*a* of the coaxial cables 4.

Further, when the receptacle connector 2 and the plug connector 3 are in this state, the contact pieces 23*a* of the first shell 23 come into contact with the second shell 34, as illustrated in FIG. 8A. This contact forms transmission lines for grounding starting from the outer conductors 4*b* of the coaxial cables 4, passing the ground bars 32, the second shell (shell A) 33, the second shell (shell B) 34, and the first shell 23, and reaching the ground electrodes 5*b* of the circuit board 5.

When the plug connector 3 is fitted into the receptacle connector 2 mounted on the circuit board 5, the walls 22A of the receptacle connector 2 are inserted into the grooves 31*a* of the plug connector 3. When the receptacle connector 2 and the plug connector 3 are in this state, the second shell 33 is brought to a state of being spaced apart from and covering the walls 22A, which constitute the receptacle connector 2, as illustrated in FIG. 8B.

In addition, the walls 22A are connected to the ground electrodes 5*b* on the circuit board 5. Therefore, the walls 22A have the same potential as that of the outer conductors 4*b* of the coaxial cables 4.

Figure 9A:
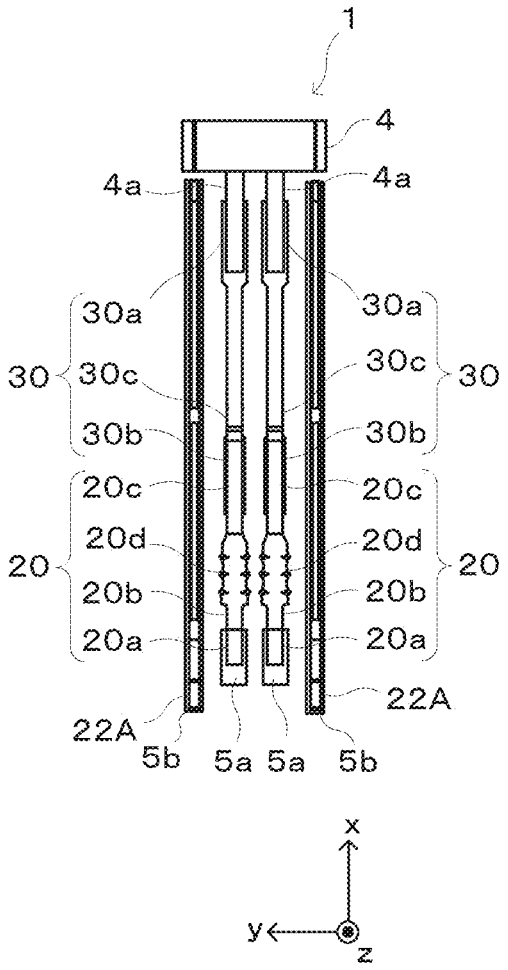
FIG. 9A is a top view schematically illustrating a pair of transmission lines.

A pair of inner conductors 4*a* of each coaxial cable 4 transmits a pair of differential signals. Therefore, as illustrated in FIG. 9A, a pair of differential signals are also transmitted through a pair of transmission lines arranged adjacent to each other in the electrical connector 1. In the electrical connector 1, the walls 22A are formed in such a way as to sandwich pairs of transmission lines each pair of which transmit a pair of differential signals. That is, the walls 22A partition the first contacts 20 and the second contacts 30 for each pair of transmission lines (each pair of contacts) transmitting a pair of differential signals. This partitioning enables each wall 22A to function as a conductor that cut off a noise emitted from a pair of transmission lines to an adjacent pair of transmission lines.

In addition, as illustrated in FIG. 9A, each wall 22A is configured to, with respect to the x-axis direction, have a length longer than that of a transmission line of a signal constituted by a first contact 20 and a second contact 30. This configuration enables the walls 22A to cover the transmission lines each of which is made up of a first contact 20, a second contact 30, and an exposed inner conductor 4*a*.

Figure 9B:
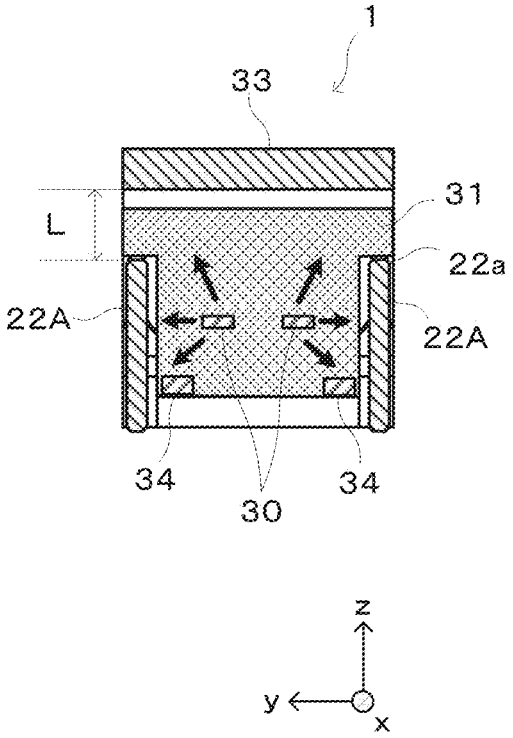
FIG. 9B is a cross-sectional view schematically illustrating the pair of transmission lines.

As illustrated in FIG. 9B, when electromagnetic noise components are emitted from a pair of transmission lines, noises emitted upward are transmitted to the first shell 23, the second shell (shell A) 33, and the second shell (shell B) 34. Noises emitted in the lateral direction and downward are transmitted to the walls 22A. This configuration enables crosstalk between pairs of transmission lines transmitting pairs of differential signals to be reduced. Electrical connectors include a connector provided with, in place of a wall 22A, a contact for grounding connected to a coaxial cable 4. However, an electrical connector of this type has a difficulty in capturing a noise emitted downward from the contacts. The electrical connector 1 is capable of transmitting even noises emitted downward from the contacts to the walls 22A.

In addition, a gap L between the upper edge 22*a* of each wall 22A and the second shell 33 (see FIG. 9B) is configured to be less than or equal to a half wavelength of a frequency at which signals are transmitted. Such a configuration enables noises to be prevented from leaking through the gaps between the second shell 33 and the walls 22A. The same applies to gaps between the walls 22A and the first shell 23. For example, since, when the frequency of signals to be transmitted is 30 GHz, the wavelength of the signals is 10 mm, the gaps are required to be set at 5 mm or less.

Figure 10:
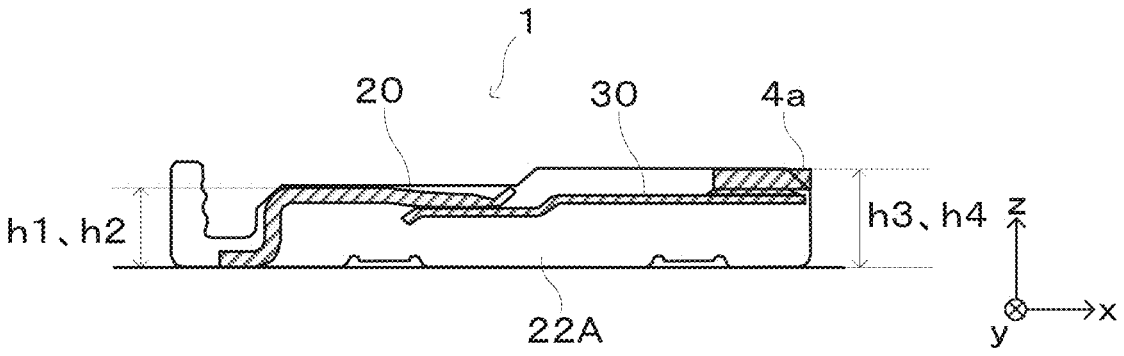
FIG. 10 is a side view schematically illustrating a transmission line and a wall.

As illustrated in FIG. 10, in the present embodiment, the height h2 of a portion of each wall 22A that faces a first contact 20 is configured to be equal to the maximum height h1 of the first contact 20 above the circuit board 5, and the height h4 of a portion of each wall 22A that faces a second contact 30 and an inner conductor 4*a* is configured to be equal to a maximum height h3 of the inner conductor 4*a* above the circuit board 5. That is, the height of each of the walls 22A above the circuit board 5 changes in accordance with the height of one of the arranged first contacts 20, one of the arranged second contacts 30, and an inner conductor 4*a* of one of the arranged coaxial cables 4. The height h4 of a portion of each wall 22A that faces a second contact 30 may be set at the same height as a maximum height of the second contact 30. Alternatively, the height of portions of each wall 22A that face a second contact 30 and an inner conductor 4*a* may be set at the same height as a maximum height of the second contact 30 and a maximum height of the inner conductor 4*a*, respectively.

Since such a configuration enables interspaces between a first contact 20, a second contact 30, and an inner conductor 4*a* and the upper edge 22*a* of each wall 22A to be set to be short, it becomes easy to transmit noise components emitted from the transmission lines including the first contact 20, the second contact 30, and the inner conductor 4*a* to the upper edge 22*a* of the wall 22A and to suppress emission of noise components to adjacent transmission lines.

As described above, the walls 22A are disposed in order to reduce crosstalk between pairs of transmission lines transmitting pairs of differential signals. Now, to what degree near end crosstalk (NEXT, an S-parameter), which is one of frequency characteristics of a transmission line, is reduced will be described.

Figure 11:
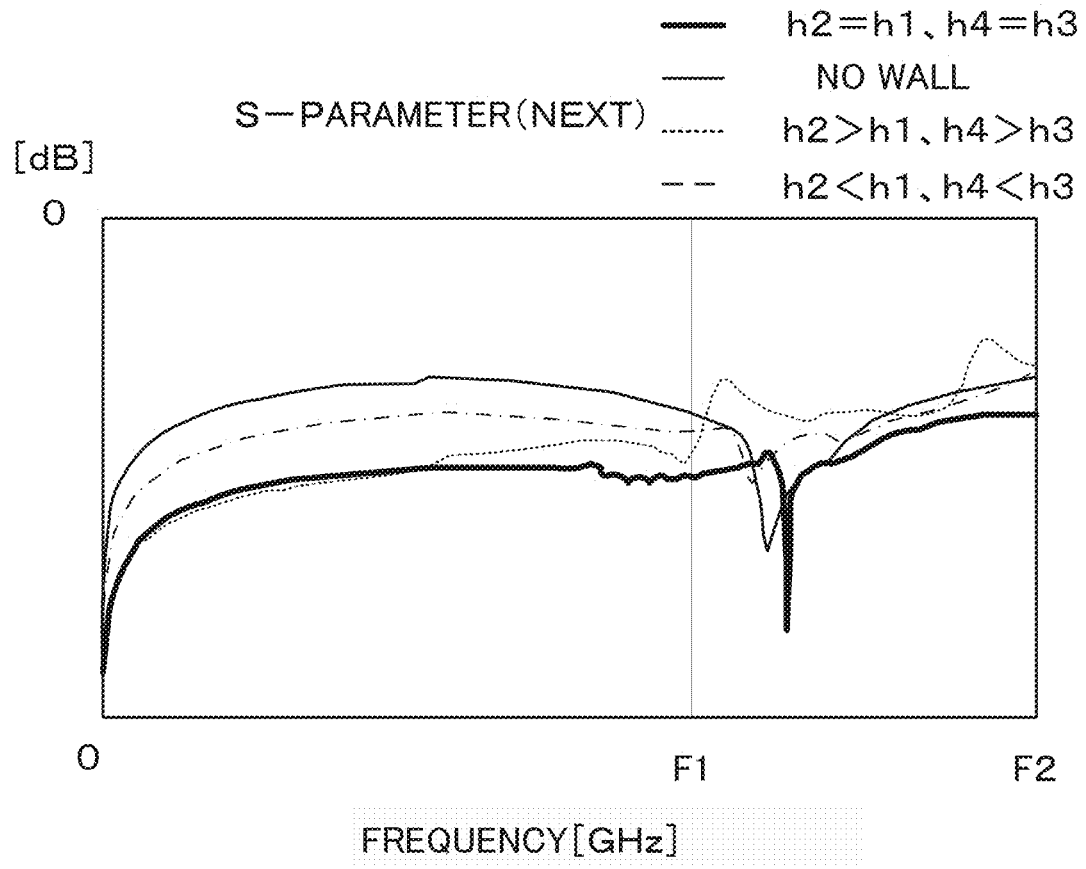
FIG. 11 is a graph comparatively illustrating frequency characteristics of signals transmitted by the electrical connector in FIG. 1 and other electrical connectors.

As indicated by the thick solid line in FIG. 11, in the electrical connector 1 according to the present embodiment, the near end crosstalk is reduced over the whole frequency range because of the walls 22A, each of which has the same height as the maximum heights of a first contact 20, a second contact 30, and an inner conductor 4*a*, as compared with a case where no wall 22A is disposed (indicated by the thin solid line).

Figure 12:
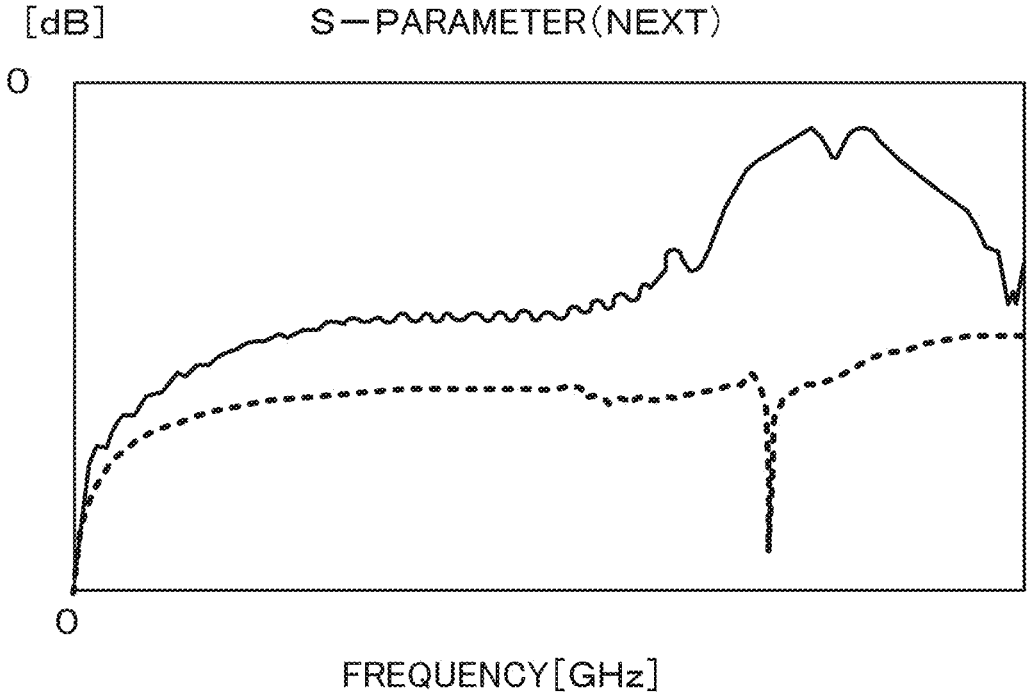
FIG. 12 is a graph illustrating a frequency characteristic of an electrical connector in which transmission lines are surrounded by shells.

In addition, as indicated by the solid line in FIG. 12, when a pair of transmission lines for signals transmitting a pair of differential signals was surrounded by a conductive shell that was configured by making the walls 22A contact the first shell 23, the second shell (shell A) 33, and the second shell (shell B) 34, the near end crosstalk, contrary to expectations, increased as the frequency of the signals increased. In FIG. 12, the dotted line indicates the frequency characteristic (near end crosstalk) of the electrical connector 1 according to the present embodiment.

As illustrated above, it was revealed that, as in the electrical connector 1 according to the present embodiment, inserting, between pairs of transmission lines each pair of which transmit a pair of differential signals and are made up of first contacts 20, second contacts 30, and inner conductors 4*a* of a coaxial cables 4, the walls 22A having the same height as the maximum heights of the first contacts 20, the second contacts 30, and the inner conductors 4*a* enabled frequency characteristics of the transmission lines to be improved. The degree of improvement achieved by the configuration was greater than in a case of surrounding the transmission lines by a conductive shell.

Further, the frequency characteristics of the transmission lines for signals change according to the height of the walls 22A. As indicated by the dotted line in FIG. 11, when the height h2 and h4 of the walls 22A are set to be higher than the height h1 of the first contacts 20 and the height h3 of the second contacts 30 and the inner conductors 4*a*, respectively (h2>h1 and h4>h3), two peaks corresponding to resonant frequencies appear in a frequency band higher than a frequency F1 (GHz) in the near end crosstalk.

Meanwhile, as indicated by the alternate long and short dash line in FIG. 11, when the height h2 and h4 of the walls 22A are set to be lower than the height h1 and h3 of the first contacts 20, the second contacts 30, and the inner conductors 4*a*, respectively (h2<h1 and h4<h3), resonant frequencies of the transmission lines for signals come to exceed a frequency F2 (GHz) and, in a frequency range of F1 (GHz) or higher and F2 (GHz) or lower, the near end crosstalk is less than that in a case where h2>h1 holds.

The analysis described thus far has revealed that there exists a phenomenon in which, as the height h2 and h4 of the walls 22A above the circuit board 5 decrease, resonant frequencies of the transmission lines including the first contacts 20, the second contacts 30, and the inner conductors 4*a* increase. Use of this phenomenon enables the height h2 and h4 of the walls 22A to be adjusted so that resonant frequencies of the transmission lines fall outside the frequency band of signals to be transmitted, that is, to be adjusted according to the frequency band of a noise targeted to be suppressed.

For example, when the frequency band of signals to be transmitted is in a range of F1 (GHz) or higher and F2 (GHz) or lower, resonant frequencies of the transmission lines are required to be set at frequencies higher than or equal to F2 (GHz) by configuring the height h2 and h4 of the walls 22A to be lower than the height h1 of the first contacts 20 and the height h3 of the second contacts 30 and the inner conductors 4*a*, respectively. Such a configuration enables noise components in a vicinity of the frequency band of signals to be transmitted to be suppressed. In addition, when the frequency band of signals to be transmitted is higher than or equal to F2 (GHz), resonant frequencies of the transmission lines are required to be set at frequencies higher than or equal to F1 (GHz) and lower than or equal to F2 (GHz) by configuring the height h2 and h4 of the walls 22A to be higher than the height h1 of the first contacts 20 and the height h3 of the second contacts 30 and the inner conductors 4*a*, respectively. Such a configuration enables noise components in a vicinity of the frequency band of signals to be transmitted to be suppressed.

Figure 13:
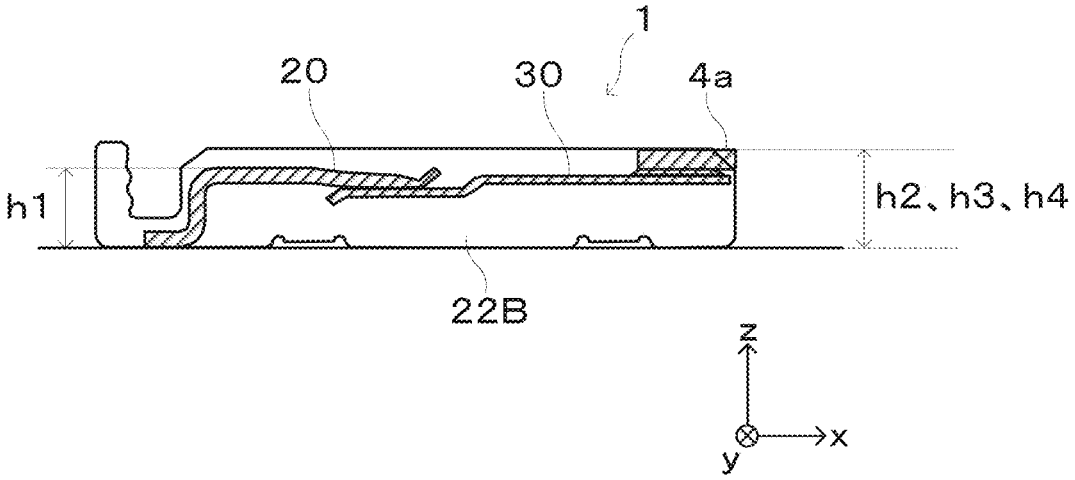
FIG. 13 is a diagram illustrating a variation of a wall.

As illustrated in FIG. 13, walls 22B that the height h2 and h4 of which above the circuit board 5 are the same (having a uniform height) may be used in place of the walls 22A. The height h2 and h4 of the walls 22B above the circuit board 5 become equal to a maximum height of the transmission lines, each of which is made up of a first contact 20, a second contact 30, and an inner conductor 4*a* of a coaxial cable 4, above the circuit board 5.

Figure 14:
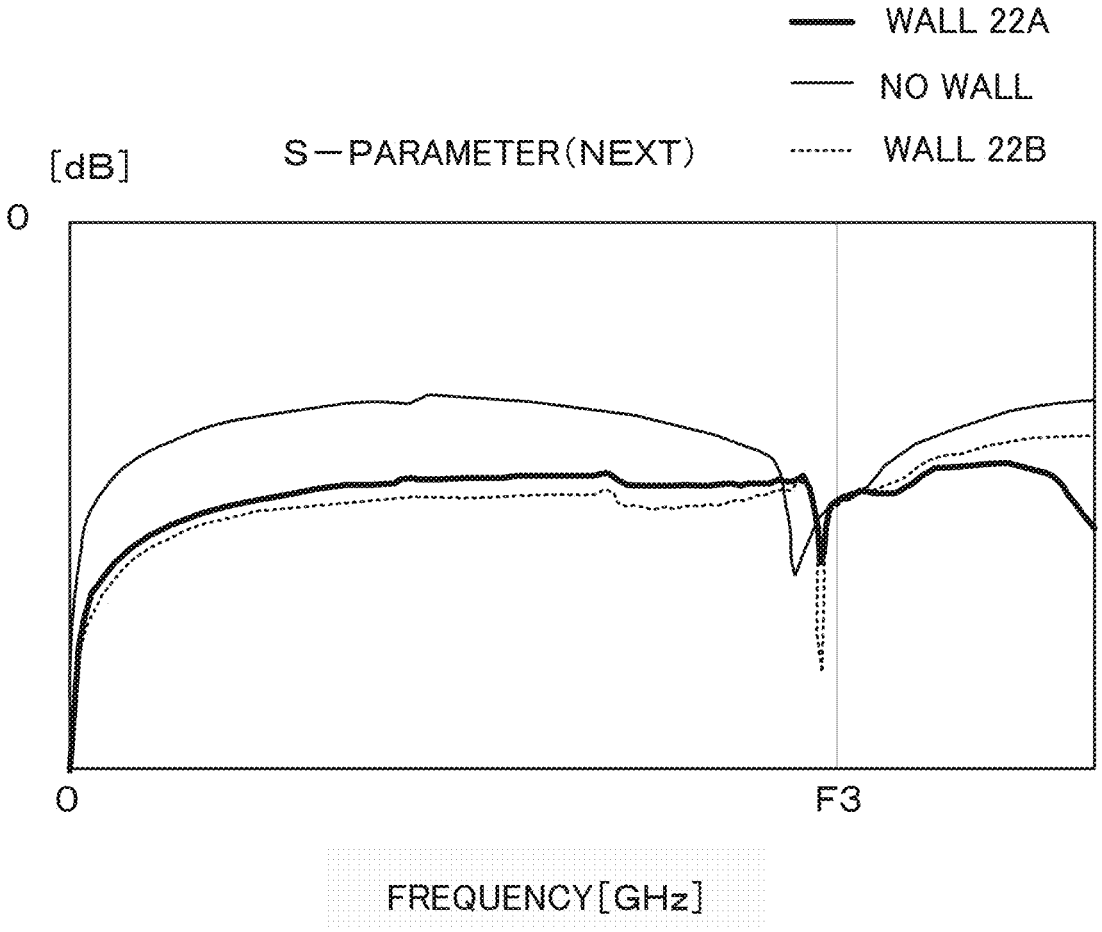
FIG. 14 is a graph comparatively illustrating a frequency characteristic of the electrical connector that includes the walls in FIG. 13.

In FIG. 14, a frequency characteristic (near end crosstalk) of the electrical connector 1 including the walls 22A is indicated by the thick solid line. As targets for comparison, frequency characteristics (near end crosstalk) of the electrical connector 1 including the walls 22B and an electrical connector not including any walls between pairs of transmission lines are indicated by the dotted line and the thin solid line, respectively. As illustrated in FIG. 14, the near end crosstalk is reduced by the electrical connector 1 according to the present embodiment in an almost similar manner to by the electrical connector 1 including the walls 22B as compared with a case where no wall is disposed. In addition, in a frequency band of a frequency F3 (GHz) or higher, the near end crosstalk of the electrical connector 1 including the walls 22A is reduced to less than that of the electrical connector 1 including the walls 22B.

As described in detail thus far, according to the embodiment described above, the conductive walls 22A or 22B, which are erected on the circuit board 5, are disposed at both ends of the arrangement of the first contacts 20 and the second contacts 30 and at locations that partition the first contacts 20 and the second contacts 30 for each signal (a pair of differential signals) to be transmitted and the walls 22A or 22B are spaced apart from the first shell 23 and the second shell 33. Since such a configuration enables the upper edges 22*a* of the walls 22A or 22B to be positioned in proximity to the first contacts 20 and the second contacts 30, noise components generated due to resonance of the transmission lines including the first contacts 20 and the second contacts 30 easily propagate to the walls 22A or 22B. As a result of this effect, it is possible to, by suppressing an increase in crosstalk due to resonance, prevent transmission quality of signals from deteriorating.

Among the above configurations, the configuration that most effectively suppresses crosstalk (that is, having a lowest near end crosstalk value) is a case where the height of the walls 22A is changed in accordance with the height of transmission lines for signals, including the first contacts 20, the second contacts 30, and the inner conductors 4*a*, in the connector with respect to the circuit board 5 taken as a reference.

A case where the frequency of signals to be transmitted, that is, the frequency of a noise that has to be reduced, and resonant frequencies of the transmission lines are set apart from each other is considered. For example, when the resonant frequencies are to be lowered, it is preferable to set the height h2 and h4 of the walls 22A or 22B higher than the maximum height h1 and h3 of the transmission lines in the connector, respectively. On the other hand, when the resonant frequencies are to be raised, it is preferable to set the height h2 and h4 of the walls 22A or 22B lower than the maximum height h1 and h3 of the transmission lines in the connector, respectively. An acceptable range for a difference between the height h2 and h4 of the walls 22A or 22B and the height h1 and h3 of the first contacts 20, the second contacts 30, and the inner conductors 4*a* may be set at ±1.5 mm, or the difference may be set at a value within width of the first contact 20, the second contacts 30, and the inner conductors 4*a*. Alternatively, the height h2 and h4 of the walls 22A or 22B are only required to be set at a height that enables at least a portion of a space between a transmission line and another transmission line arranged adjacent thereto in the connector to be shielded. Still alternatively, the height h2 and h4 of the walls 22A or 22B above the circuit board 5 may be higher than the height h3 of the inner conductors 4*a* of the coaxial cables 4 above the circuit board 5.

Setting the height h2 and h4 of the walls 22A to be lower or higher than the height h1 and h3 of the first contacts 20, the second contacts 30, and the inner conductors 4*a* as described above enables the resonant frequencies of the transmission lines for signals to be set apart from the frequency of the signals and crosstalk due to resonance to be thereby reduced.

While the walls 22A or 22B function as members that transmit noises emitted from the transmission lines in the connector, changing the height h2 and h4 of the walls 22A or 22B causes the resonant frequencies of the transmission lines to be changed. Therefore, it is preferable that the height h2 and h4 of the walls 22A or 22B be determined according to the frequency of signals to be transmitted.

Although, in the embodiment described above, the second shell constituting the plug connector 3 is separated into the second shell (shell A) 33 and the second shell (shell B) 34, the two second shell components may be combined into one body.

In the embodiment described above, a case where the coaxial cables 4, each of which contains a pair of inner conductors 4*a*, are connected was described. However, the present disclosure is not limited to the case. The present disclosure is applicable to an electrical connector in which coaxial cables each of which contains an inner conductor are connected to a circuit board.

Although, in the embodiment described above, the electrical connector 1 that transmits differential signals was described, the present disclosure is not limited to the electrical connector 1. The present disclosure is applicable to an electrical connector that transmits single-end signals.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure is applicable to an electrical connector that electrically connects coaxial cables to a circuit board and transmits high-frequency signals.

REFERENCE SIGNS LIST

1 Electrical connector
2 Receptacle connector
3 Plug connector
4 Coaxial cable
4*a* Inner conductor
4*b* Outer conductor
4*c* Insulator
4*d* Outer coating
5 Circuit board
5*a* Signal electrode
5*b* Ground electrode
20 First contact
20*a* Board connecting portion
20*b* Rising portion
20*c* First contact contacting portion
20*d* Locking portion
21 First housing
22A, 22B Wall
22*a* Upper edge
23 First shell
23*a* Contact piece
30 Second contact
30*a* Cable connecting portion
30*b* Second contact contacting portion
30*c* Locking portion
31 Second housing
31*a* Groove
32 Ground bar
33 Second shell (shell A)
34 Second shell (shell B)
33*a* Pull bar

What is claimed is:

1. An electrical connector comprising:

a first connector that is mounted on a circuit board; and a second connector that is connected to coaxial cables and, through fitting of the first connector and the second connector to each other, connecting the circuit board and the coaxial cables to each other, wherein the first connector includes:

a plurality of conductive first contacts to each of which a board connecting portion that connects to the circuit board, a rising portion that, bending at one end of the board connecting portion, extends in a direction away from the circuit board, and a first contact contacting portion that, bending at one end of the rising portion, extends in a direction along the circuit board and comes into contact with an opposite contact disposed to the second connector are formed and that are arranged in a row;

conductive walls that have lower edges extending along the first contacts and connected to ground electrodes of the circuit board and upper edges provided opposite to the lower edges and extending along the first contacts, are disposed at both ends of an arrangement of the first contacts and at locations that partition the first contacts for each signal to be transmitted, and partition, at least when the first connector is fitted to the second connector, the opposite contacts at both ends of an arrangement of the opposite contacts and for each signal to be transmitted;

an insulating first housing that holds the first contacts and the walls; and a conductive first shell that is mounted to the first housing in such a manner as to be spaced apart from and cover the first contacts and the walls and is connected to a ground electrode of the circuit board, the second connector includes:

a plurality of conductive second contacts to each of which a cable connecting portion that connects to an inner conductor of one of the coaxial cables and a second contact contacting portion that comes into contact with one of the first contact contacting portions when the second connector is fitted to the first connector are formed and that extend in a direction along the circuit board, are arranged in a row in a corresponding manner to the first contacts, and serve as the opposite contacts;

an insulating second housing that holds the second contacts; and a conductive ground bar that connects to outer conductors of the coaxial cables, and a gap extending along the circuit board is disposed between the upper edges of walls and the first shell.

2. The electrical connector according to claim 1, wherein based on a phenomenon in which, as a height of each of the walls above the circuit board decreases, a resonant frequency of each transmission line including one of the first contacts and one of the second contacts increases, the height of each of the walls above the circuit board is specified to a height corresponding to a frequency band of a noise targeted to be suppressed.

3. The electrical connector according to claim 1, wherein a height of each of the walls above the circuit board changes in accordance with a height of one of the first contacts and one of the second contacts.

4. The electrical connector according to claim 1, wherein a height of each of the walls above the circuit board is higher than a height of an inner conductor of one of the coaxial cables above the circuit board.

5. The electrical connector according to claim 1, wherein a gap between the walls and the first shell is shorter than a half wavelength of a signal transmitted via one of the first contacts and one of the second contacts.

6. The electrical connector according to claim 1, wherein the walls partition the contacts from each other for each pair of contacts transmitting a pair of differential signals.

7. The electrical connector according to claim 1, wherein each of the coaxial cables includes a pair of inner conductors that transmit a pair of differential signals, and the pair of inner conductors are connected to a pair of the second contacts sandwiched by the walls.

* * * * *